US006482072B1

(12) United States Patent
Gurusamy et al.

(10) Patent No.: US 6,482,072 B1
(45) Date of Patent: Nov. 19, 2002

(54) METHOD AND APPARATUS FOR PROVIDING AND CONTROLLING DELIVERY OF A WEB OF POLISHING MATERIAL

(75) Inventors: Jayakumar Gurusamy, Newark, CA (US); Gee Sun Hoey, San Jose, CA (US); Lawrence M. Rosenberg, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 82 days.

(21) Appl. No.: 09/698,396

(22) Filed: Oct. 26, 2000

(51) Int. Cl.[7] ..... B24B 1/00

(52) U.S. Cl. ..... 451/4; 451/10; 451/168; 451/307; 451/311; 451/499

(58) Field of Search ..... 451/311, 168, 451/307, 4, 304, 499, 500, 317; 474/101, 125; 125/16.02

(56) References Cited

U.S. PATENT DOCUMENTS

| | | | | |
|---|---|---|---|---|
| 4,930,259 | A | * | 6/1990 | Kobylenski et al. ..... 451/168 |
| 5,081,795 | A | | 1/1992 | Tanaka et al. |
| 5,216,843 | A | | 6/1993 | Breivogel et al. |
| 5,232,875 | A | | 8/1993 | Tuttle et al. |
| 5,329,732 | A | | 7/1994 | Karlsrud et al. |
| 5,335,453 | A | | 8/1994 | Baldy et al. |
| 5,384,986 | A | | 1/1995 | Hirose et al. |
| 5,498,196 | A | | 3/1996 | Karlsrud et al. |
| 5,498,199 | A | | 3/1996 | Karlsrud et al. |
| 5,549,511 | A | | 8/1996 | Cronin et al. |
| 5,554,064 | A | | 9/1996 | Breivogel et al. |
| 5,558,568 | A | | 9/1996 | Talieh et al. |
| 5,569,062 | A | | 10/1996 | Karlsrud |
| 5,593,344 | A | | 1/1997 | Weldon et al. |
| 5,595,529 | A | | 1/1997 | Cesna et al. |
| 5,597,346 | A | | 1/1997 | Hempel, Jr. |
| 5,643,044 | A | | 7/1997 | Lund |
| 5,645,471 | A | | 7/1997 | Strecker |
| 5,669,804 | A | * | 9/1997 | Takahashi et al. ..... 451/59 |
| 5,679,064 | A | | 10/1997 | Nishi et al. |
| 5,704,827 | A | | 1/1998 | Nishi et al. |
| 5,738,574 | A | | 4/1998 | Tolles et al. |
| 5,791,969 | A | | 8/1998 | Lund |
| 5,944,585 | A | * | 8/1999 | Nagahara et al. ..... 451/56 |
| 6,068,542 | A | | 5/2000 | Hosokai |
| 6,244,935 | B1 | * | 6/2001 | Birang et al. ..... 451/41 |
| 6,273,800 | B1 | * | 8/2001 | Walker et al. ..... 451/168 |
| 6,277,005 | B1 | * | 8/2001 | Reynen et al. ..... 451/168 |
| 6,306,014 | B1 | * | 10/2001 | Walker et al. ..... 451/41 |
| 6,319,103 | B1 | * | 11/2001 | Kim ..... 451/168 |

FOREIGN PATENT DOCUMENTS

| | | |
|---|---|---|
| EP | 0 517 594 A1 | 6/1992 |
| EP | 0 696 495 A1 | 2/1996 |
| EP | 0 770 455 A1 | 5/1997 |
| EP | 0 774 323 A2 | 5/1997 |
| EP | 0 774 323 A3 | 10/1997 |
| JP | 09029634 | 2/1997 |
| JP | 9-248753 | 9/1997 |
| WO | WO 98/45090 | 10/1998 |

* cited by examiner

*Primary Examiner*—George Nguyen
(74) *Attorney, Agent, or Firm*—Moser, Patterson & Sheridan

(57) ABSTRACT

Generally, a method and apparatus for supporting a web of polishing material. In one embodiment, the apparatus includes a platen adapted to support the web, a frame assembly, and one or more flexures coupled between the platen and the frame assembly. The flexure allows the frame assembly to be moved in relation to the platen. When the frame assembly is in an extended position relative to the platen, the web is placed in a spaced-apart relation to the platen.

13 Claims, 6 Drawing Sheets

METHOD AND APPARATUS FOR PROVIDING AND CONTROLLING DELIVERY OF A WEB OF POLISHING MATERIAL

BACKGROUND OF THE DISCLOSURE

1. Field of Invention

Embodiments of the present invention relate generally to a system and a method for supporting a web in a polishing system.

2. Background of Invention

In semiconductor wafer processing, the use of chemical mechanical planarization, or CMP, has gained favor due to the enhanced ability to increase device density on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

CMP systems generally include a polishing head, a platen and polishing material disposed on the platen. A substrate retained in the polishing head is pressed against the polishing material and moved relative to the polishing material in the presence of a polishing fluid. Abrasives, typically contained in the polishing fluid or polishing material, remove material from the surface of the substrate synergistically with the chemical activity provided by the polishing fluid.

One type of polishing material that includes abrasives disposed therein is known as fixed abrasive material. The fixed abrasive material comprises a plurality of abrasive particles suspended in a resin binder that is disposed in discrete elements on a backing sheet. As the abrasive particles are contained in the polishing material itself, systems utilizing fixed abrasive material generally use polishing fluid that do not contain abrasives. Such polishing fluids enhance the service life of their fluid delivery systems.

Fixed abrasive polishing material is generally available in stick-down form but is often utilized in the form of a web. Generally, the web is periodically advanced over the course of polishing a number of substrates as the polishing surface of the web is consumed by the polishing process. A vacuum is typically applied between the web and platen to fix the web to the platen during the polishing process. When the web is advanced, the vacuum is removed, freeing the web from the platen's surface.

However, indexing the web across a polishing platen is sometimes difficult. Fluids that come in contact with the web may cause surface tension or attraction to develop between the web and the underlying surface of the platen.

This surface tension must be over-come to accomplish advancement of the web. If the attraction between the web and platen is great, the indexing means may not be able to index the web or the web may become damaged during the indexing process.

Providing a cushion of gas between the web and platen assists in overcoming the attraction between the web and platen. The gas lifts the web to a spaced-apart relation to the platen where the web may be freely indexed. However, providing gas to the area between the web and platen is complicated, and requires rotary union and process tubing to be routed through an already crowded platen.

Therefore, there is a need for an improved apparatus that supports a web of polishing material.

SUMMARY OF INVENTION

One aspect of the invention generally provides an apparatus for supporting a web of polishing material. In one embodiment, the apparatus includes a platen adapted to support the web, a frame assembly, and one or more flexures coupled between the platen and the frame assembly. The frame assembly may be actuated to lift the web into a space-apart relation relative to the platen.

In another aspect of the invention, method for supporting a web of polishing material is provided. In one embodiment, the method includes the steps of supporting a web across a frame at least partially circumscribing a platen and moving the frame assembly in relation to the platen. In one position, the frame assembly places the web in a space-apart relation relative to the platen.

In another aspect of the invention, an apparatus for tensioning a web of polishing material between a supply roll and a take-up roll is provided. In one embodiment, the apparatus includes a first drive adapted to pull the polishing material in a first direction, a clutch mechanism coupled to the first drive, and a second drive adapted to pull the polishing material in a second direction that opposes the first direction.

In another aspect of the invention, a method for tensioning a web of polishing material between a supply roll and a take-up roll is provided. In one embodiment, the method includes the steps of driving a first motor to urge the polishing material in a first direction, and driving a second motor to urge the polishing material in a second direction that opposes the first direction. In another embodiment, a method for tensioning includes the steps of disposing the web across a polishing platen having a guide supporting the web at one end of the platen, disposing a first sensor between the platen and one end of the guide, disposing a second sensor between the platen and another end of the guide, and generating a signal from the first and second sensors that is indicative of web tension.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

Figure 1:
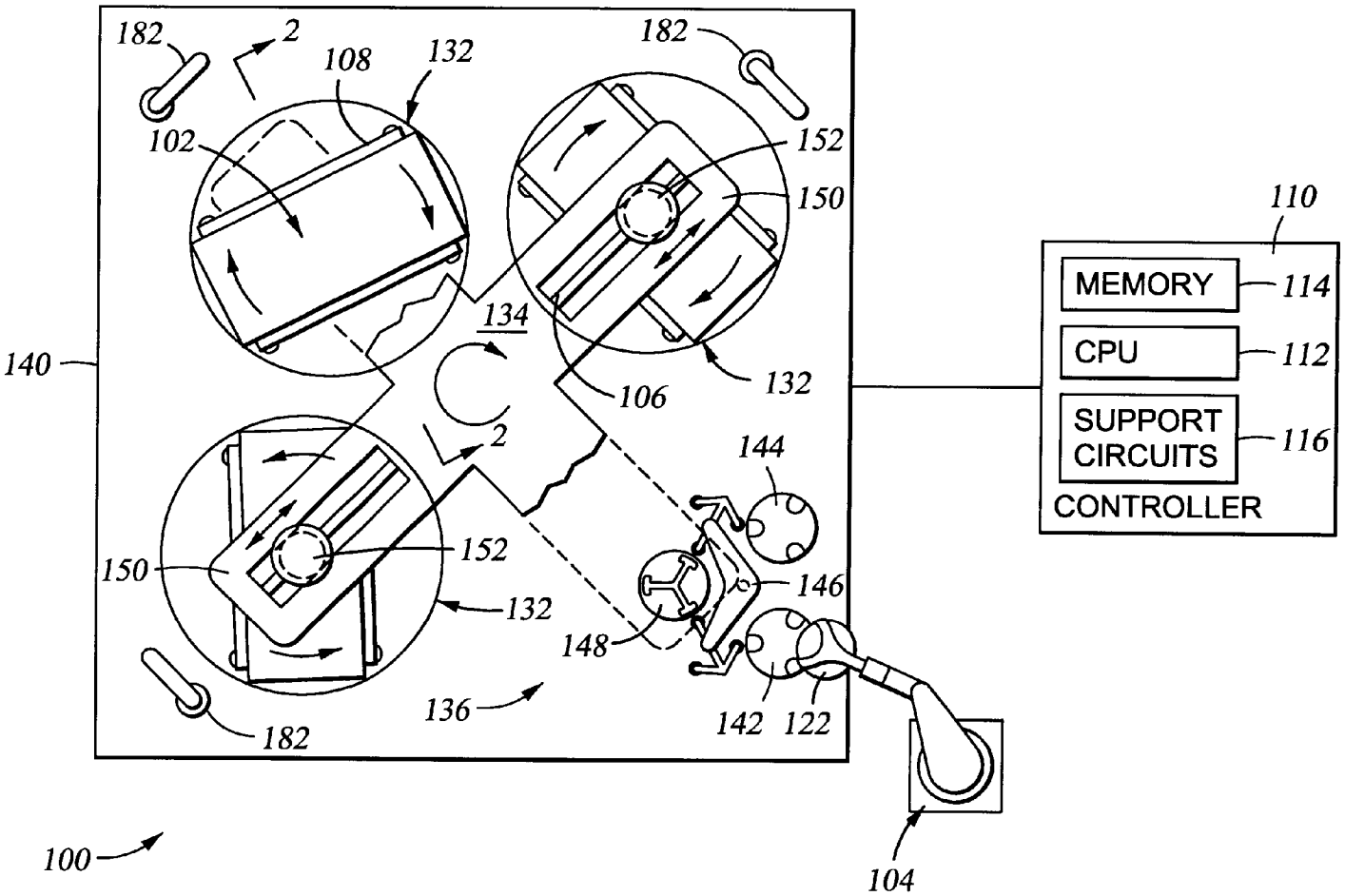
FIG. 1 is a plan view of a chemical mechanical planarization system of the invention.

FIG. 1 depicts a plan view of one embodiment of a chemical mechanical polisher 100 having a platen assembly 108. One polisher 100 that can be used to advantage with the present invention is a REFLEXIONS™ Chemical Mechanical Polisher, manufactured by Applied Materials, Inc., located in Santa Clara, Calif. Although the platen assembly 108 is described on one configuration of a chemical mechanical polisher, one skilled in the art may advantageously adapt embodiments of platen assembly 108 as taught and described herein to be employed on other chemical mechanical polishers that utilize a web of polishing material.

An exemplary polisher 100 is generally described in U.S. patent application Ser. No. 09/244,456, filed Feb. 4, 1999 to Birang et al., which is incorporated herein by reference in its entirety. The polisher 100 generally comprises a loading robot 104, a controller 110, a transfer station 136, a plurality of polishing stations 132 each including one platen assembly 108, a base 140 and a carousel 134 that supports a plurality of polishing heads 152. Generally, the loading robot 104 is disposed proximate the polisher 100 and a factory interface (not shown) to facilitate the transfer of substrates 122 therebetween.

The transfer station 136 generally includes a transfer robot 146, an input buffer 142, an output buffer 144 and a load cup assembly 148. The input buffer station 142 receives a substrate 122 from the loading robot 104. The transfer robot 146 moves the substrate 122 from the input buffer station 142 and to the load cup assembly 148 where it may be transferred between the polishing head 152. An example of a transfer station that may be used to advantage is described by Tobin in U.S. patent application Ser. No. 09/314,771, filed Oct. 6, 1999, which is incorporated herein by reference in its entirety.

To facilitate control of the polisher 100 as described above, the controller 110 comprising a central processing unit (CPU) 112, support circuits 116 and memory 114, is coupled to the polisher 100. The CPU 112 may be one of any form of computer processor that can be used in an industrial setting for controlling various polishers, drives, robots and subprocessors. The memory 114 is coupled to the CPU 112. The memory 114, or computer-readable medium, may be one or more of readily available memory such as random access memory (RAM), read only memory (ROM), floppy disk, hard disk, or any other form of digital storage, local or remote. The support circuits 116 are coupled to the CPU 112 for supporting the processor in a conventional manner. These circuits include cache, power supplies, clock circuits, input/output circuitry, subsystems, and the like.

Generally, the carousel 134 has a plurality of arms 150 that each support one of the polishing heads 152. Two of the arms 150 depicted in FIG. 1 are shown in phantom such that a polishing material 102 disposed on one of the polishing stations 132 and the transfer station 136 may be seen. The carousel 134 is indexable such that the polishing heads 152 may be moved between the polishing stations 132 and the transfer station 136.

Generally, a chemical mechanical polishing process is performed at each polishing station 132 by moving the substrate 122 retained in the polishing head assembly 152 relative to the polishing material 102 supported on the polishing station 132. The web of polishing material 102 may have a smooth surface, a textured surface, a surface containing a fixed abrasive or a combination thereof. The web of polishing material 102 may be advanced across or releasably fixed to the polishing surface. Typically, the web of polishing material 102 is releasably fixed by adhesives, vacuum, mechanical clamps or by other holding methods to the polishing station 132.

The web of polishing material 102 generally has a polishing side 256 and a backside 258. In one embodiment, the polishing side 256 of the polishing material 102 includes fixed abrasives. Fixed abrasives typically comprise a plurality of abrasive particles suspended in a resin binder that is disposed in discrete elements on a backing sheet. Examples of such fixed abrasive pads are available from Minnesota Manufacturing and Mining Company, of Saint Paul, Minn. The web of polishing material 102 may optionally comprise conventional polishing material without fixed abrasives, for example, polyurethane foam available from Rodel Inc., of Newark, Del.

Generally, a conditioning device 182 is disposed on the base 140 adjacent each polishing station 132. The conditioning device 182 periodically conditions the polishing material 102 to maintain uniform polishing results.

The polishing head 152 is generally coupled to the carousel 102 by a drive system 106. The drive system 106 generally provides motion to the polishing head 152 during processing. In one embodiment, the polishing head 152 is a TITAN HEAD™ wafer carrier manufactured by Applied Materials, Inc., Santa Clara, Calif. Generally, the polishing head 152 comprises a housing in which is disposed a bladder (not shown). The bladder may be controllably inflated or deflated. The bladder, when in contact with the substrate 122, retains the substrate 122 within the polishing head 152 by deflating, thus creating a vacuum between the substrate 122 and the bladder. A retaining ring (not shown) circumscribes the polishing head 152 to retain the substrate 122 within the polishing head 152 adjacent the bladder while polishing.

Figure 2:
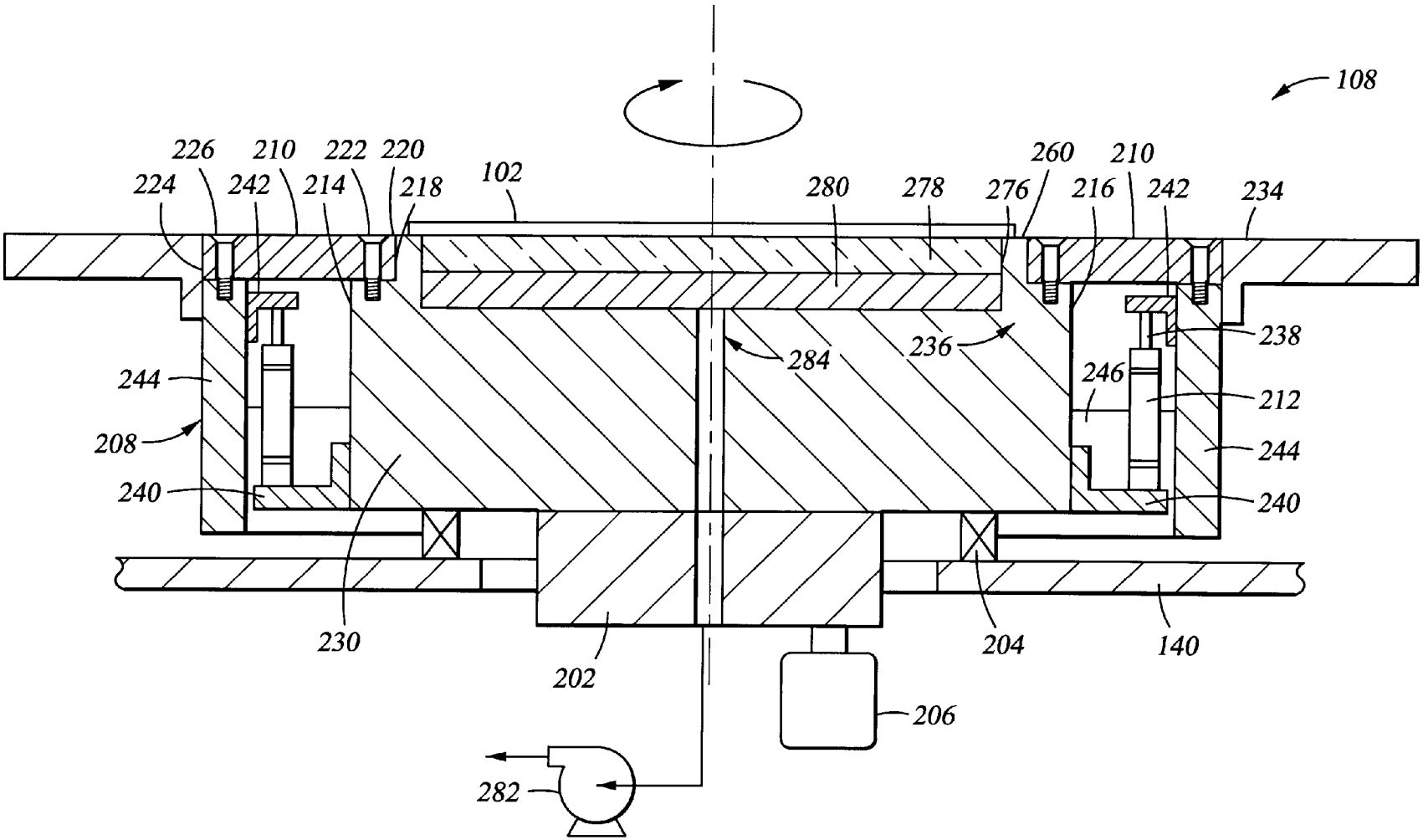
FIG. 2 is a sectional view of a polishing station taken along section line 2—2 of FIG. 1.

FIG. 2 depicts a sectional view of the polishing station 132. The polishing station 132 generally includes a hub 202 and the platen assembly 108 that supports the polishing material 102. The platen assembly 108 is supported above the base 140 by a bearing 204. The hub 202 is coupled to the platen assembly 108 at one end and is coupled to a drive system 206 (e.g., an electric motor) at the opposite end. The drive system 204 provides rotational motion to the hub 202, causing the platen assembly 108 to rotate.

Generally, an area of the base 140 circumscribed by the bearing 204 is open and provides a conduit for the electrical, mechanical, pneumatic, control signals and connections communicating with the platen assembly 108. Conventional bearings, rotary unions and slip rings (not shown) are provided such that electrical, mechanical, pneumatic, control signals and connections are coupled between the base 140 and the rotating hub 202 and platen assembly 108.

The platen assembly 108 generally comprises a frame assembly 208, a platen 230, at least one flexure 210 and at least one actuator 212. A first side 214 of the platen 230 is coupled to the hub 202. A second side 216 of the platen 230 supports the web of polishing material 102. The flexure 210 is coupled between the platen 230 and frame assembly 208. The flexure 210 allows the frame assembly 208 to move vertically relative the platen 230 while preventing lateral and rotational motion between the frame assembly 208 and the platen 230.

In one embodiment, the platen 230 is comprised of aluminum. The platen 230 has an upper portion 236 that supports the web of polishing material 102. A top surface 260 of the platen 230 contains two side recesses 218 and a center recess 276 extending into the top portion 236. Each side recess 218 respectively accommodates a first side 220 of the flexure 210. The depth of the side recesses 218 are typically selected such that the flexure 210 is flush with the top surface 260 of the platen 230. A plurality of fasteners 222, such as screws, bolts, rivets and the like, secure the flexure 210 to the platen 230. Alternatively, the flexure 210 may be secured to the platen 230 by other means such as clamping, welding, adhering and the like.

A subpad 278 and a subplate 280 are disposed in the center recess 276. The subpad 278 is typically a plastic, such as polycarbonate or foamed polyurethane. Generally, the hardness or durometer of the subpad may be chosen to produce a particular polishing result. The subpad 278 generally maintains the polishing material 102 parallel to the plane of the substrate 122 held in the polishing head 152 and promotes global planarization of the substrate 122. The subplate 280 is positioned between the subpad 278 and the bottom of the recess 276 such that the upper surface of the subpad 278 is maintained coplanar with the top surface 260 of the platen 230.

A vacuum port 284 is provided in the recess 276 and is coupled to an external pump 282. When a vacuum is drawn through the vacuum port 284, the air removed between the polishing material 102 and the subpad 278 causes the polishing material 102 to be firmly secured to the subpad 278 during polishing. An example of such polishing material retention system is disclosed in U.S. patent application Ser. No. 09/258,036, filed Feb. 25, 1999, by Sommer et al., which is hereby incorporated herein by reference in its entirety. The reader should note that other types of devices may be utilized to releasably fix the polishing material 102 to the platen 230, for example releasable adhesives, bonding, electrostatic chucks, mechanical clamps and other releasable retention mechanisms.

Optionally, to assist in releasing the polishing material 102 from the subpad 278 and platen 230 prior to advancing the polishing material 102, surface tension caused by fluid that may be disposed between the subpad 278 and the polishing material 102 is overcome by a blast of fluid (e.g., air) provided through the vacuum port 284 or other port (not shown) into the recess 276 by the pump 282 (or other pump). The fluid pressure within the recess 276 moves through apertures (not shown) disposed in the subpad 278 and subplate 280 and lifts the polishing material 102 from the subpad 278 and the top surface 260 of the platen 230. Alternatively, the subpad 278 may be a porous material that permits gas (e.g., air) to permeate therethrough and lift the polishing material 102 from the platen 230. Such a method for releasing the web of polishing material 102 is described in U.S. Patent Application No. 60/157,303, filed Oct. 1, 1999, by Butterfield, et al., and is hereby incorporated herein by reference in its entirety.

The top portion 236 of the platen 230 may optionally include a plurality of passages 244 disposed adjacent to the recess 276. The passages 244 are coupled to a fluid source (not shown). Fluid flowing through the passages 244 may be used to control the temperature of the platen 230 and the polishing material 102 disposed thereon.

The flexure 210 generally comprises a flexible material of sufficient strength to constrain the frame assembly 208 and platen 230 while the platen assembly 108 is rotating. Generally, the flexure 210 may comprise different geometric forms. For example, the geometry of the flexure 210 may be varied to control the flex characteristics and rigidity of the flexure 210. By changing the geometry of the flexure 210, design variations such as platen rotation speed, displacement of the frame assembly 208 relative to the platen 230, weight of the frame assembly 208 and the number of flexures 210 incorporated into the platen assembly 210 may be accommodated. In one embodiment, the flexure 210 comprises a sheet of stainless steel, wherein one flexure 210 is fastened between each side recess 218 and the platen 230. Other flexures 210 may include stiffening ribs, embossing, slots or have holes formed therein.

Generally, the first side 220 of the flexure 210 is coupled to the platen 230 and a second side 224 is coupled to the frame assembly 208. Typically, the second side 224 is coupled to the side rails 244 using fasteners 226 in the same fashion as the first side 220 is coupled to the platen 230.

The platen assembly 108 typically includes one or more actuators 212 that provide the bias force required to displace the frame assembly 208 in relation to the platen 230. In one embodiment, the platen assembly 108 includes two actuators 212, one mounted between each side rail 244 and the platen 230. Generally, the actuator 212 is disposed on a mounting pad 240 that is coupled to the platen 230. A rod 238 of the actuator 212 typically contacts a contact plate 242 that is disposed on the side rail 244. The actuator 212, shown in a retracted position in FIG. 2, has an extended position. In the extended position, the rod 238 urges the contact plate 242 away from the mounting plate 240. The resulting force from the actuator 212 causes the flexure 210 to flex, allowing an upper surface 234 of the frame assembly 208 to elevate from a position coplanar with the top surface 260 of the platen 230.

Figure 3:
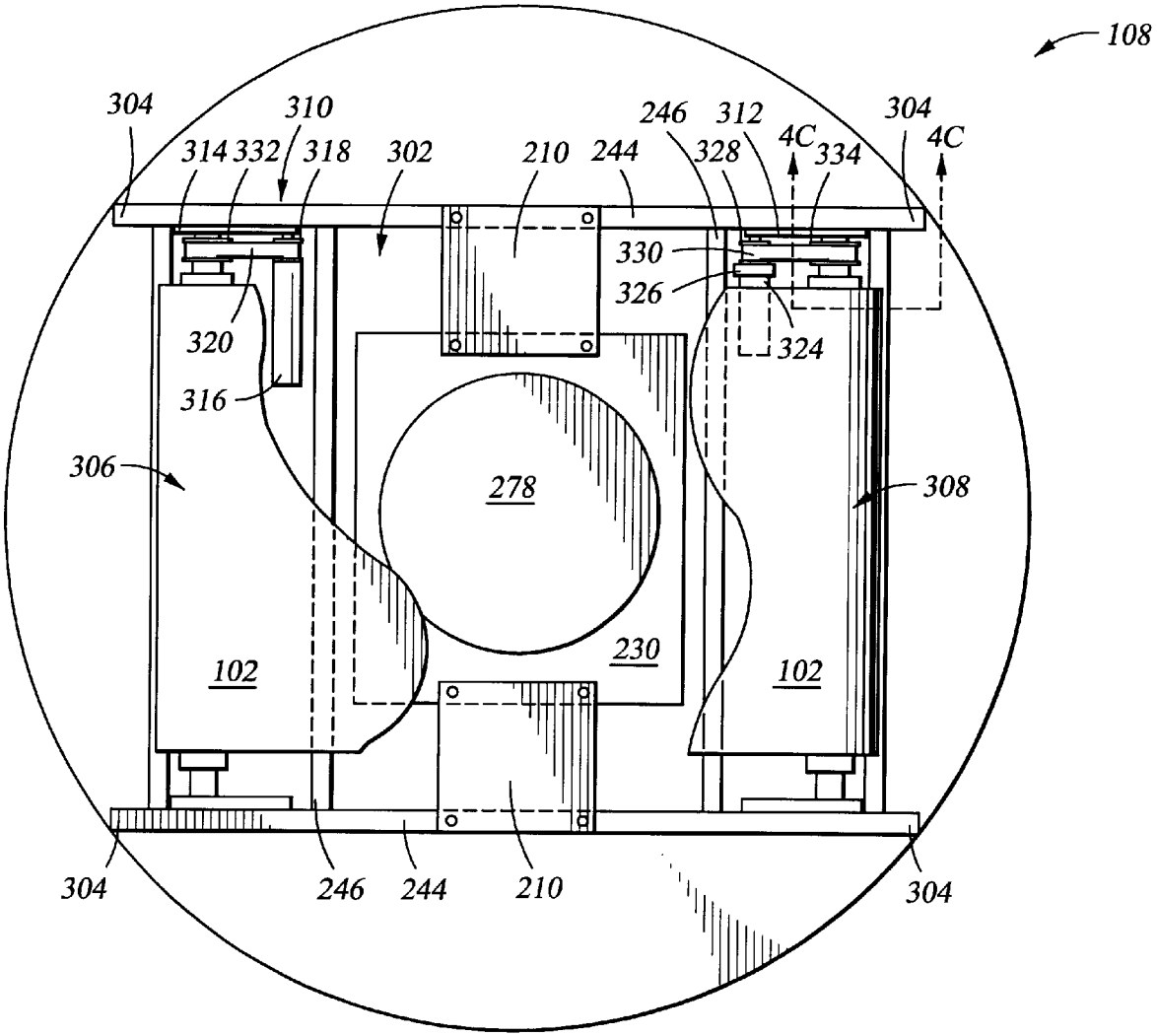
FIG. 3 is a plan view of one embodiment of a platen assembly.

FIG. 3 depicts a plan view of one embodiment of the frame assembly 208. The frame assembly 208 generally includes the two side rails 244 and the two end rails 246. Optionally, guards 340 may be coupled to each of the rails 244 and 246. The guards 340, which are generally semicircular in shape, give the platen assembly 108 a circular plan form that shields the corners of the platen assembly 108 during rotation.

The rails 244 and 246 are coupled and define a rectangular center section 302 that accommodates the platen 230. The side rails 244 have end sections 304 that extend beyond the end rails 246. Mounted between one pair of end sections 304 on opposing end rails 246 is a web supply assembly 306. A web take-up assembly 308 is mounted between the other pair of end sections 304 on the opposite side of the platen 230. The web of polishing material 102 is disposed across the platen 230 between the web supply assembly 306 and web take-up assembly 308. Generally the web supply assembly 306 holds an unused portion of the web of polishing material 102 while the web take-up assembly 308 holds a used portion of the web of polishing material 102.

A first web drive 310 is coupled to one of the side rails 244 of the frame assembly 208. The first web drive 310 generally tensions the web of polishing material 102 disposed across the platen 230. The first web drive 310 additionally permits the web of polishing material 102 to be unwound from the web supply assembly 306.

The first web drive 310 generally comprises a mounting pad 314 that supports a motor 316. The mounting pad 314 is coupled to the side rail 244. The motor 316 typically is an electric motor that incorporates a harmonic drive, however, other types of motors with or without gear reducers may be utilized. For example, solenoid, gear motors, hydraulic, electric motors, stepper, servo or air motors may be utilized. Disposed between the motor 316 and mounting pad 314 is a pulley 318. The pulley 318 drives a belt 320 that turns a second pulley 332. The second pulley 332 provides the rotary motion utilized to tension the web of polishing material 102 in the web supply assembly 306. The belt 320 is typically a timing belt. Optionally, the belt 320 and pulleys 318, 332 may be replaced with gears or other motion transfer devices.

A second web drive 312 is coupled on the opposite side of the platen 230 to one of the side rails 244 of the frame assembly 208. The second web drive 312 may be coupled to the same or opposite side rail 244 that the first web drive 310 is coupled to. Generally, the second drive system 312 advances the web of polishing material 102 across the platen 230 from the web supply assembly 306 to the web take-up assembly 308. Alternatively, the web drives 310 and 312 may be coupled to the platen 230.

The second web drive 312 generally Comprises a mounting pad 322 that supports a motor 324. The motor 324 is configured similarly to the motor 316. The mounting pad 322 is coupled to the side rail 244. The motor 324 is typically coupled to a clutch 326 that allows rotation in only one direction. The clutch 326 is configured to prevent the motor 324 from rotating in a direction that would allow the web of polishing material 102 to unwind from the takeup assembly 308. Alternatively, the motor 324, such as an electric motor, may be controlled in to prevent rotation, for example, by application of a brake or electronically through the motor controls.

Disposed between the clutch 326 and mounting pad 322 is a pulley 328. The pulley 328 drives a belt 330 that turns a second pulley 334. The second pulley 334 provides the rotary motion utilized to wind the web of polishing material 102 onto the web take-up assembly 308. The belt 330 is typically a timing belt. Optionally, the belt 330 and pulleys 328, 334 may be replaced with gears or other motion transfer devices.

Figure 4A:
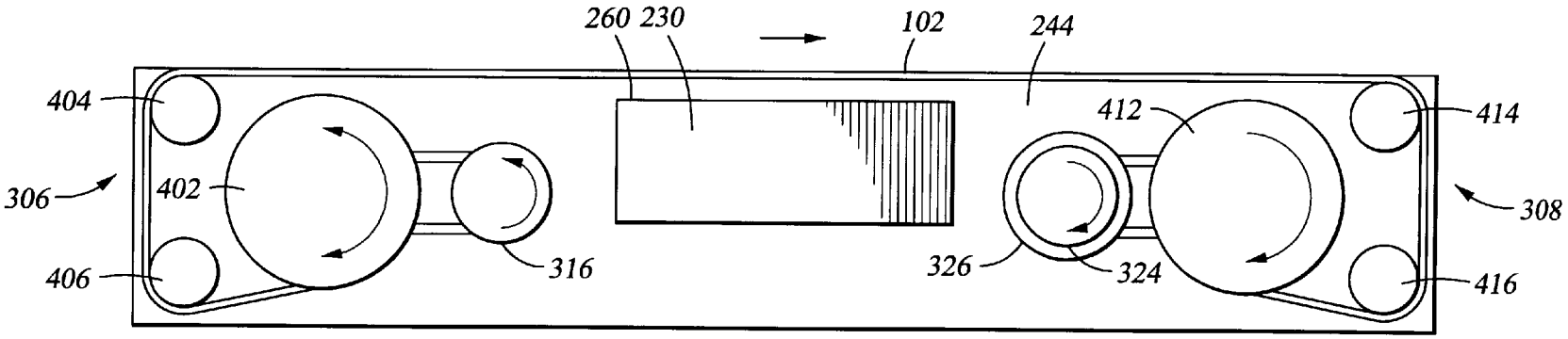
FIG. 4A depicts a polishing material disposed between a supply assembly and a take-up assembly.
Figure 4B:
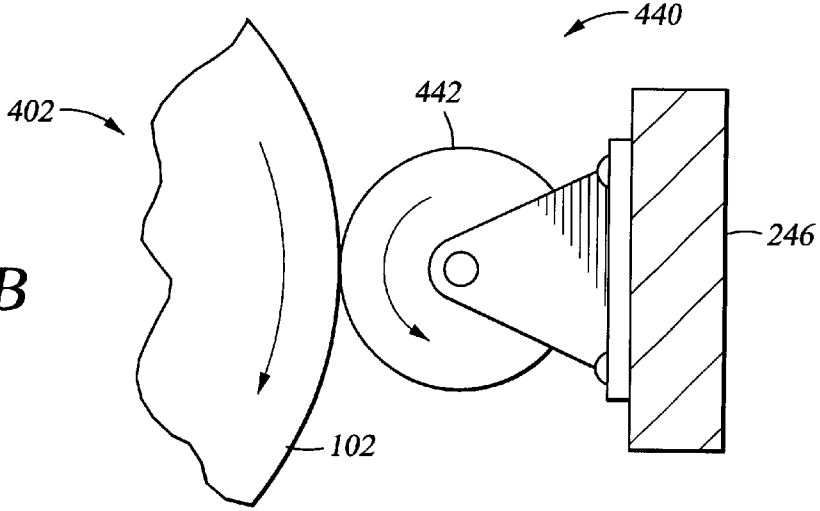
FIG. 4B depicts a sensor for indicating the movement of a polishing material.
Figure 4C:
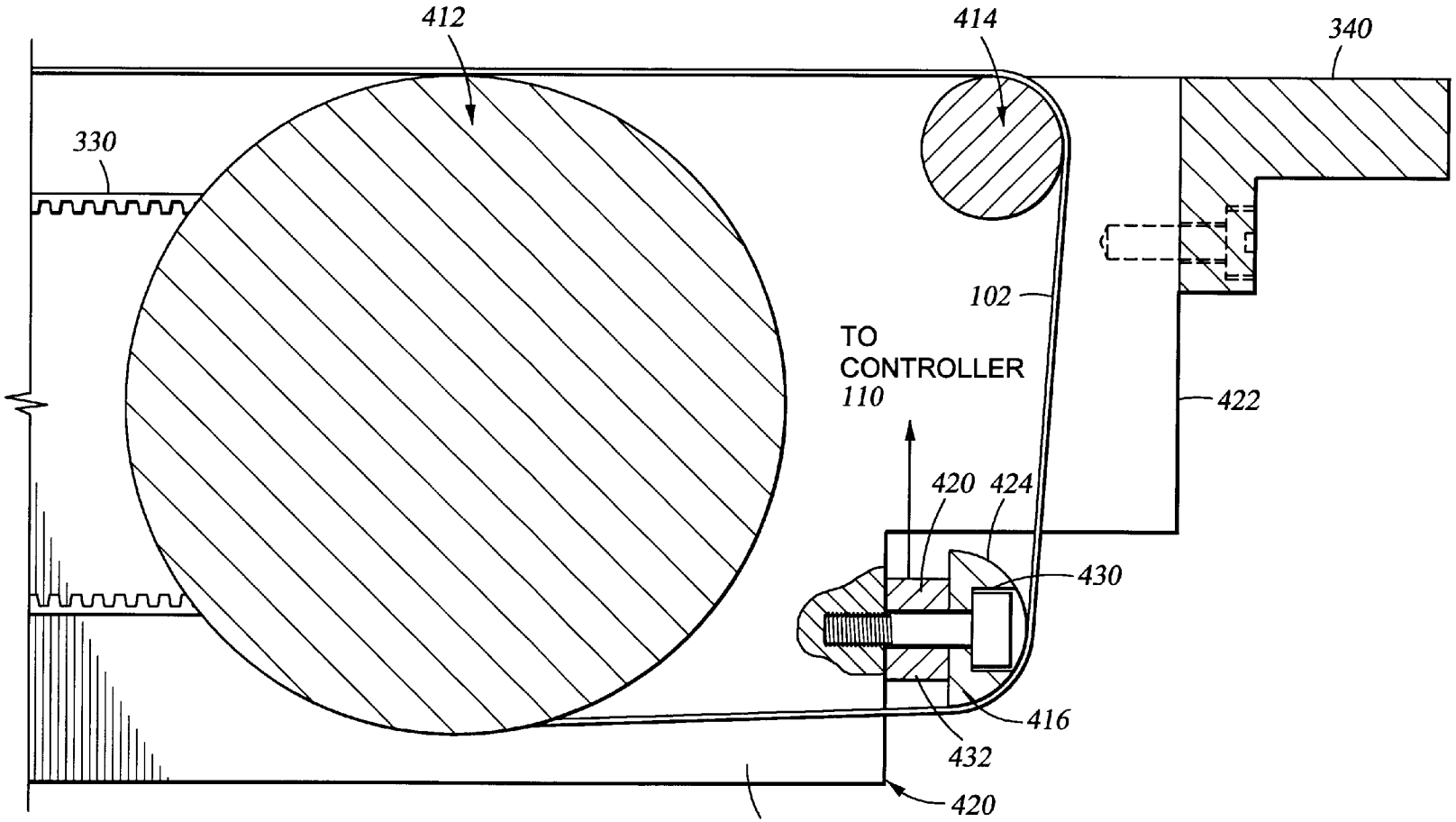
FIG. 4C is a sectional view of the platen assembly taken along section line 4C—4C of FIG. 3.

Referring to FIGS. 4A–4C, one embodiment of the web supply assembly 306 and the web take-up assembly 308 that illustrates the movement of the web of polishing material 102 across the platen 230. Generally, the web supply assembly 306 includes a supply roll 402, an upper guide member 404 and a lower guide member 406 that are disposed between the side rails 244. The supply roll 402 generally contains an unused portion of polishing material 102 and is configured to that it may easily be replaced with another supply roll containing new polishing material once the polishing material 102 disposed on the supply roll 402 has been consumed by the polishing process. One embodiment of a replaceable supply roll 402 is disclosed in the previously incorporated U.S. patent application Ser. No. 09/244,456 to Birang et al.

The supply roll 402 generally interfaces with the pulley 332 that is coupled to the mounting pad 314. The belt 320 is disposed between the pulleys 318 and 332 such that the motion provided by the motor 316 is transferred to the supply roll 402.

The lower guide member 406 is positioned to lead the web of polishing material 102 from the supply roll 402 to the upper guide member 404. The upper guide member 404 is disposed between the side rails 244 such that the polishing material 102 leading off the roller 404 is disposed substantially coplanar (i.e., lies immediately adjacent and parallel) to the top surface 260 of the platen 230. The guide members 404 and 406 may comprise a bar having a radius or chamfer that protects the polishing. material 102 moving thereover from damage. Alternatively, the guide members 404 and 406 may comprise rollers or shafts to further facilitate travel of the polishing material 102 thereover.

Generally, the web take-up assembly 308 includes a take-up roll 412, an upper guide member 414 and a lower guide member 416 that are all disposed between the side rails 244. The take-up roll 412 generally contains a used portion of polishing material 102 and is configured so that it may easily be replaced with an empty take-up roll once take-up roll 412 is filled with used polishing material 102. The take-up roll 412 generally interfaces with the pulley 334 that is coupled to the mounting pad 322. The belt 330 is disposed between the pulleys 328 and 334 such that the motion provided by the motor 324 is transferred to the take-up roll 412.

The upper guide member 414 is positioned to lead the web of polishing material 102 from the platen 230 to the lower guide member 416. The lower guide member 416 leads the web of polishing material 102 onto the take-up roll 412. The guide members 416 and 418 may comprise a bar having a radius or chamfer that protects the polishing material 102 moving thereover from damage. Alternatively, the guide members 416 and 418 may comprise rollers or shafts to further ease the travel of the polishing material 102.

The web of polishing material 102 is generally moved in relation to the platen 230 by balancing the forces between the motor 316 coupled to the supply assembly 306 and the motor 324 coupled to the takeup assembly 308. For example, to advance the polishing material 102 across the platen 230, the motor 324 Is driven to apply a greater force on the polishing material 102 than the motor 316. The pull of polishing material 102 by the takeup roll 412 exceeds the opposing force applied to the supply roll 402, thus causing the polishing material 102 to unwind from the supply roll 402 and be wound on the takeup roll 412.

To control the amount of polishing material 102 advanced, a sensor is positioned to contact the polishing material 102 or one of the rollers in contact with the polishing material 102. In one embodiment, a rotary encoder 440 coupled to the controller 110, is disposed on one of the end rails 246. The encoder 440 touches the surface of the polishing material 102 such that as the polishing material advances, a rotating element 442 of the encoder 440 is caused to rotate an amount corresponding to the linear displacement of the polishing material 102. The encoder 440 provides feedback to controller 110 which is used to balance the force between the motors 316, 324 so that the web of polishing material 102 may advance a predetermined amount.

Conversely the web of polishing material 102 is prevented from creeping across the platen 230 during polishing by driving the motor 316 to apply a greater force on the polishing material than the motor 324. The motor 316 pulls the polishing material towards the supply roll 402. As the take-up roll 412 can not unroll the polishing material 102 against the one-way clutch 326 disposed in the second drive system 312, the polishing material 102 is stretched tightly (i.e., tensioned) between the supply roll 402 and take-up roll 412.

Generally, one or both of the web supply assembly 306 or take-up assembly 308 incorporates a tension sensor 408. In one embodiment, the sensor 408 is coupled to the lower guide member 416. The lower guide member 416 is disposed between a notches 420 formed in an end 422 of opposing rails 244. The tension sensor 408 generally comprises two load cells 423, one disposed between each end of the guide bar 416 and the notch 420. Alternatively, the tension sensor 408 may incorporated with other guide bars, the supply or take-up rolls.

Generally, the lower guide member 416 of the tension sensor 408 has a curved surface 424 (or alternatively a roller) that contacts the polishing material 102. The guide member 416 has a through hole 426 disposed in each end of the guide member 416. A mounting fastener 428 is disposed in the hole 428 and fastens the guide member 416 to each rail 244.

Each hole 428 includes a counter bore 430 so that a head of the fastener 428 is disposed beneath the surface 424 as not to incidentally contact the polishing media 102.

The load cells 432 are coupled to the controller 110. Each load cell 432 is disposed on the fastener 428 between the guide member 416 and the rail 244. The fastener 428 is typically a shoulder screw that captures the guide 416 and load cell 432 to the rail 244 without generating a load upon the cell 432. The use of two load cells 432, one on each side of the web of polishing material 102 permits the determination of the overall tension on the web of polishing material 102 along with the load upon each side of the web. The controller 110 enables a predetermined tension to be applied and maintained on the polishing material 102 by utilizing the tension sensed by the load cells 432 in conjunction with the force applied on the motor 316.

Referring primarily to FIGS. 2 and 3, in one example of operation, the polishing material 102 is advanced across the platen 230 as follows. The vacuum applied between the platen 230 and the polishing material 102 is removed. Optionally, a blast of air may be provided between the platen 230 and the polishing material 102. The actuator 212 is then activated to force the frame assembly 208 upwards relative to the platen 230. The flexure 210 restricts the relative motion of the frame assembly 208 relative to the platen 230 so that the frame assembly 208 can only move coaxial to the platen 230.

As the frame assembly 208 reaches an extended position, the upper guide members 404, 414 that are coupled to the frame assembly 208 places the polishing material 102 in a spaced-apart relation to the top surface 260 of the platen 230. In this spaced-apart position, the surface tension of fluids that may be disposed between the polishing material 102 and the platen 230 is overcome as the polishing material 102 is raised by the frame assembly 208.

The force generated by the motor 324 disposed in the second drive system 312 is increased to overcome the force applied on the polishing material 102 by the motor 316. Alternatively, the force generated by the motor 316 may be decreased alone or in conjunction with the increase of the force generated by the motor 324. The imbalance of force on the polishing material 102 causes an unused amount of polishing material 102 to unwind from the web supply assembly 306 and be wound upon the take-up roll 412 of the web take-up assembly 308.

The controller 110, in response to the signal generated from the encoder 440, maintains the imbalance between the motors 316 and 324 until a predetermined length of polishing material 102 is advanced. Once the predetermined length has been advanced, the controller 110 causes the motor 316 to generate a force upon the polishing material 102 that exceeds the force generated by the motor 324. The imbalance of forces causes the polishing material 102 to be pulled towards the web supply assembly 306. As the clutch 326 prevents the polishing material 102 from advancing in that direction, the polishing material 102 is held tightly between the supply roll 402 and take-up roll 412.

The tension sensor 408 provides the controller 110 with a signal indicative of the tension on the polishing material. The controller 110 adjusts the relative forces applied to the polishing material 102 by the motors 316, 324 to maintain a predetermined tension on the polishing material 102.

Figure 5:
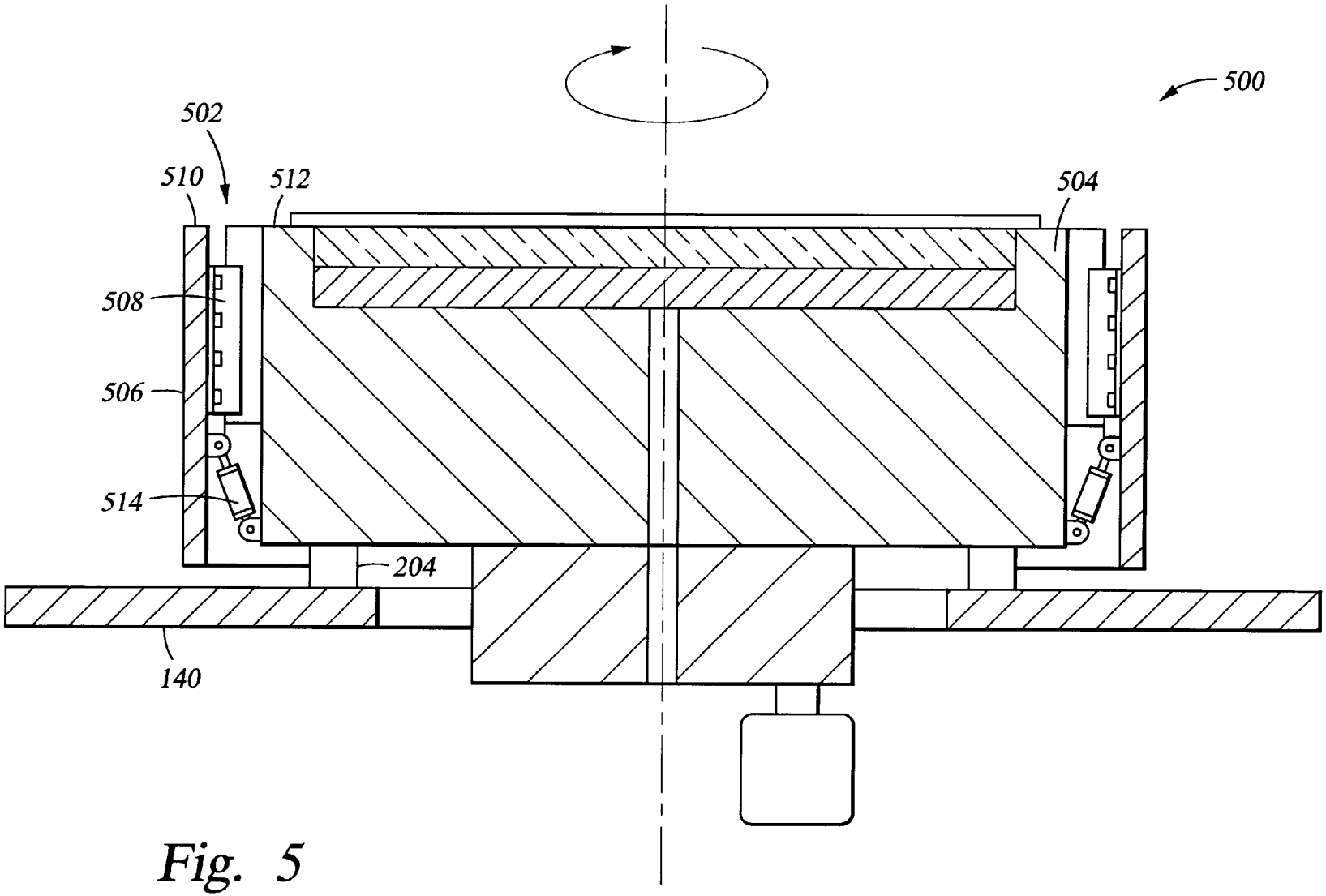
FIG. 5 is another embodiment of a platen assembly.

FIG. 5 depicts another embodiment of a platen assembly 500. The platen assembly 500 is substantially similar to the platen assembly 108 described in reference to FIGS. 3 and 4, except the platen assembly 500 includes a lifting means 502 disposed between a platen 504 and frame assembly 506. Generally, the lifting means 502 maintains the relative orientation between the platen 504 and frame assembly 506 while allowing coaxial movement therebetween.

For example, the lifting means 502 may include linear bearings 508. The bearings 508 are disposed between the platen 504 and frame assembly 506 such that the frame assembly 506 may move vertically to offset a top surface 510 of the frame assembly 506 relative to a top surface 512 of the platen 504. The bearings 508, while allowing movement in one direction, constrain the platen 504 and frame assembly 506 from moving laterally or rotating relative one another.

The lifting means 502 may additionally incorporate a cylinder 514 to provide the bias force necessary to displace the frame assembly 506. The lifting means 502 may alternatively comprise one or more flexures, linear bearing, rails, solenoids, linear actuators, pneumatic actuators, hydraulic actuators, electric motors, air motors or other linear motion devices.

Although the teachings of the present invention that have been shown and described in detail herein, those skilled in the art can readily devise other varied embodiments that still incorporate the teachings and do not depart from the scope and spirit of the invention.

What is claimed is:

1. Apparatus for tensioning a web of polishing material between a supply roll and a take-up roll, the apparatus comprising:

a first drive adapted to pull the polishing material in a first direction;

a clutch mechanism coupled to the first drive; and a second drive adapted pull the polishing material in a second direction that opposes the first direction.

2. The apparatus of claim 1, wherein the clutch mechanism prevents movement of the polishing material in the second direction.

3. The apparatus of claim 1, wherein the first drive is a stepper motor, a harmonic drive, a pneumatic motor, a hydraulic motor, an electric motor, an air motor or a solenoid.

4. The apparatus of claim 1, wherein the first drive applies a force to the web that exceeds an opposing force applied to the web by the second drive, causing the web to advance.

5. The apparatus of claim 1, wherein the force applied by the first drive causes the web to be wound on the take-up roll.

6. The apparatus of claim 1, wherein the second drive applies a force to the web that exceeds an opposing force applied to the web by the first drive, causing the web to remain stationary.

7. The apparatus of claim 6, wherein the force applied by the second drive causes the web to be tensioned between the clutch mechanism and the supply roll.

8. The apparatus of claim 1 further comprising:

a platen; and a frame assembly at least partially circumscribes the platen, the drives coupled to the frame assembly.

9. The apparatus of claim 1 further comprising:

a platen having the drives coupled thereto.

10. A method for tensioning a web of polishing material between a supply roll and a take-up roll, the method comprising the steps of:

driving a first motor to urge the polishing material in a first direction;

driving a second motor to urge the polishing material in a second direction that opposes the first direction.

11. The method of claim 10 further comprising the step of:

preventing the polishing material from moving in the first direction by engaging a one-way clutch mechanism coupled to the second drive.

12. The method of claim 10 wherein the drive system holds the polishing material stationary against a force generated by the first motor, causing the polishing material to be tensioned.

13. The method of claim 10 wherein the force exerted on the polishing material generated by the second motor exceeds the force exerted on the polishing material generated by the first motor, causing the polishing material to move in the second direction.

* * * * *

UNITED STATES PATENT AND TRADEMARK OFFICE

CERTIFICATE OF CORRECTION

PATENT NO. : 6,482,072 B1 
DATED : November 19, 2002
INVENTOR(S) : Jayakumar Gurusamy, Gee Sun Hoey and Lawrence M. Rosenberg It is certified that error appears in the above-identified patent and that said Letters Patent is hereby corrected as shown below:

Column 7,
Line 8, "Comprises" should read -- comprises --.
Line 17, delete "in".
Line 36, should read -- configured so that it may easily be replaced with another --.
Line 56, delete the period "." between "polishing" and "material".

Column 8,
Line 59, add -- be -- between "may" and "incorporated".

Column 9,
Line 2, add -- so -- after "beneath the surface 424".

Column 10,
Line 39, add -- to -- after "a second drive adapted".

Signed and Sealed this

Third Day of August, 2004

JON W. DUDAS
*Acting Director of the United States Patent and Trademark Office*